US006701628B2

(12) United States Patent
Mang

(10) Patent No.: US 6,701,628 B2
(45) Date of Patent: Mar. 9, 2004

(54) GUIDE BAR FOR A PORTABLE HANDHELD WORK APPARATUS

(75) Inventor: Harald Mang, Winnenden (DE)

(73) Assignee: Andreas Stihl AG & Co., Waiblingen (DE)

( * ) Notice: Subject to any disclaimer, the term of this patent is extended or adjusted under 35 U.S.C. 154(b) by 4 days.

(21) Appl. No.: 10/211,644

(22) Filed: Aug. 5, 2002

(65) Prior Publication Data

US 2003/0029045 A1 Feb. 13, 2003

(30) Foreign Application Priority Data

Aug. 11, 2001 (DE) ..... 101 39 590

(51) Int. Cl.[7] ..... B27B 17/04
(52) U.S. Cl. ..... 30/384; 30/371
(58) Field of Search ..... 30/382–385, 371

(56) References Cited

U.S. PATENT DOCUMENTS 2,888,964 A * 6/1959 Mall ..... 30/384
2,964,073 A * 12/1960 Gudmundsen ..... 30/384
5,174,029 A * 12/1992 Talberg ..... 30/384
6,588,110 B2 * 7/2003 Galster et al. ..... 30/384

* cited by examiner

*Primary Examiner*—Douglas D. Watts
(74) *Attorney, Agent, or Firm*—Walter Ottesen

(57) ABSTRACT

A guide bar (1) is provided for a portable handheld work apparatus, such as a motor-driven chain saw or overhead branch cutter, and includes an elongated, flat base body (4) having a peripherally extending guide groove for guiding a saw chain (6). In the region of the direction-changing section (14) at the free tip (13) of the guide bar (1), the saw chain (6) is laterally partially covered by guide discs (17, 18) which rotate with the idler sprocket (19). The guide discs (17, 18) include radially projecting sections (20, 20'). Corresponding radially projecting sections (20) of one guide disc (17) are arranged offset relative to the radially projecting sections (20') of the other guide disc (18). With this constructive measure, the manipulation of the portable handheld work apparatus is improved.

16 Claims, 6 Drawing Sheets

GUIDE BAR FOR A PORTABLE HANDHELD WORK APPARATUS

BACKGROUND OF THE INVENTION

A known guide bar includes guide plates on respective longitudinal sides of the guide bar in the region of the guide bar tip. The guide plates laterally extend beyond the guide paths formed by a guide groove in the guide bar. The radial projection of the guide plates with respect to the guide groove is so provided that the chain links of a saw chain are substantially laterally covered and only the cutting links of the saw chain extend beyond the edge of the guide plates. The saw chain is guided in the guide groove of the guide bar. In this way, it is ensured that the penetration depth of the cutting links into the material to be cut is reduced during plunge cutting work. Difficulties with respect to the manipulation during plunge cutting work are intended to be reduced thereby.

Too large a projection of the guide plates leads, however, to a reduction of the cutting power and plunge cutting work during tree maintenance is thereby hindered. On the other hand, if the projection of the guide plates (especially in the direction-changing region of the guide bar) is too low, then the manipulation of the motor-driven chain saw is made more difficult thereby.

SUMMARY OF THE INVENTION

It is an object of the invention to provide a guide bar wherein the guidance of the saw chain is improved while maintaining a good cutting power during plunge cutting work and the guide bar can be used for saw chains of different configuration.

The guide bar of the invention is for a portable handheld work apparatus including a motor-driven chain saw or overhead branch cutter, the guide bar being for a saw chain including cutting links, lateral connecting links and center drive links pivotally connected to each other via rivets or pins with the drive links having respective rakers formed thereon. The guide bar includes: an elongated planar base body defining an outer periphery wherein a peripheral guide groove is provided for receiving the rakers therein and for guiding the saw chain along the outer periphery; the guide bar having guiding surfaces along the outer periphery for supporting the lateral connecting links and the cutting links and the guiding surfaces being separated from each other by the guide groove; the guide bar having a direction-changing section at the outer free end thereof for guiding the saw chain over the outer free end of the guide bar; guide plates mounted on the base body in the direction-changing section and extending radially beyond the guiding surfaces to laterally cover the connecting links and the cutting links of the saw chain; an idler sprocket rotatably mounted in the direction-changing section; the guide plates being configured as rotating left and right guide discs and the guide discs being connected to the idler sprocket so as to rotate therewith; and, the left guide disc having a set of radially projecting first sections and the right guide disc having a set of radially projecting second sections arranged offset with respect to corresponding ones of the first sections.

According to the invention, the guide plates in the direction-changing section (at the tip of the guide bar) are configured as rotating guide discs and are connected to the idler sprocket so as to rotate therewith. In this way, a reliable guidance of the guide bar on a motor-driven chain saw or an overhead branch cutter is combined with good cutting power with the aid of the guide plates on the guide bar. In lieu of a circularly-shaped edge, the guide discs include sections which project radially and each cutting link of the saw chain comes partially into overlapment with a radially projecting section. The radially projecting sections can have an outline which is rectangular, rhombic, trapezoidal or define a polygon in another manner.

The left and right guide plates on the direction-changing section of the guide bar alternately overlap a cutting link because of the arrangement of the radially projecting sections offset in the running direction. The cutting links each have a front cutting edge running essentially radially and this cutting edge has a contour laterally offset to the outside referred to the running direction of the saw chain and therefore projects axially beyond the outer surfaces of the guide discs in the region of the cutouts between the radially extending sections. Referred to the running direction of the saw chain, a depth limiter is positioned ahead of the front cutting edge. It can be advantageous to so arrange the radially projecting sections that they axially overlap the depth limiter. Alternatively to this, it is, however, also possible to so place the saw chain that the depth limiters are disposed in the region of a radial edge of the radially projecting section of the opposite-lying guide disc. The radial edge runs ahead when viewed in the peripheral direction. With the above-mentioned constructive measures, the function of the depth limiter as an element, which limits the penetration depth of the particular cutting link, is supported by the arrangement of one of the radially projecting sections to the depth limiter and the manipulation of the saw chain is simplified. On the other hand, the cutting power of each front cutting edge is not hindered by the radially projecting sections and therefore a good cutting power especially in plunge cutting operations is ensured.

Difficulties with respect to the manipulation of the guide bar during plunge cutting work do not occur when the radially projecting sections (measured in the peripheral direction of the guide discs) are spaced so far on a particular guide disc that two cutting links partially and one connecting link can come to lie in the cutout between each two radially projecting cutouts. It is practical to so arrange the edges of the radially projecting sections that the edges are angled so as to depart from the perpendicular. Perpendiculars are here understood to be center perpendiculars of the guide discs and parallels to the center perpendiculars of the guide discs. It is seen as practical to configure the cutouts between the radially projecting sections of each guide disc in the peripheral direction approximately as long as the width of the radially projecting sections. To make possible uniform plunge cutting work with the guide bar, it is practical to end the edge of the guide discs with a slight spacing radially below a roof cutting edge of the cutting link.

The idler sprocket is surrounded on both sides by side plates in the direction-changing section. These side plates radially project beyond the idler sprocket and axially guide the latter. In each side plate, a bearing is provided for rotatably journalling the idler sprocket and the guide discs which run with the idler sprocket. The guide discs are preferably connected to the idler sprocket so as to rotate therewith and are driven by the movable saw chain. Preferably, the guide discs are fixed at the direction-changing section of the guide bar so as to be exchangeable and can be exchanged with the saw chain.

It is practical to provide each guide disc with three or even two radially projecting sections. To be able to use conventional saw chains in combination with the guide bar, it is practical to configure the idler sprocket with a number of teeth which amounts to four times the number of radially projecting sections. In an advantageous embodiment, the idler sprocket has eight or twelve teeth. It can be practical to so configure the guide bar that it can be turned over. For this purpose, the guide discs are configured in their basic outline to be axially symmetrical.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
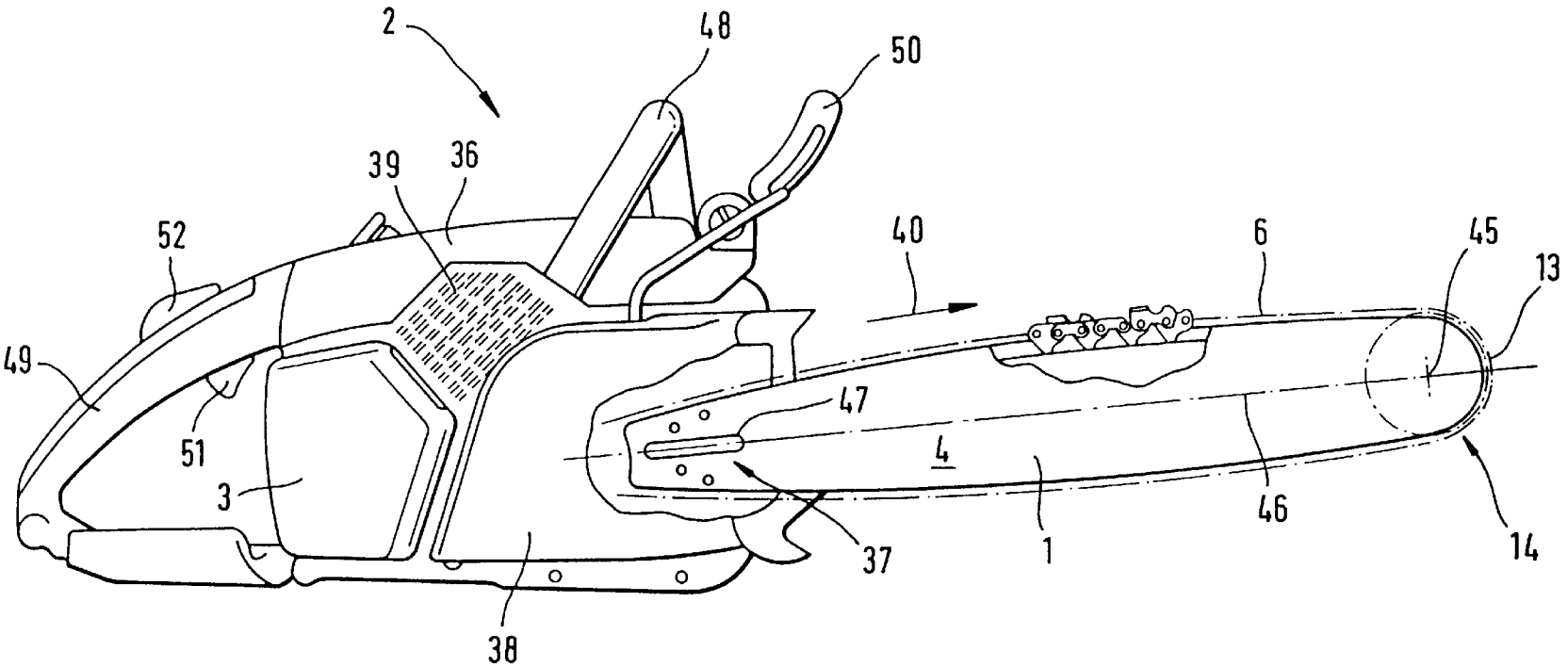
FIG. 1 is a schematic side elevation view of a motor-driven chain saw equipped with a guide bar according to the invention.
Figure 2:
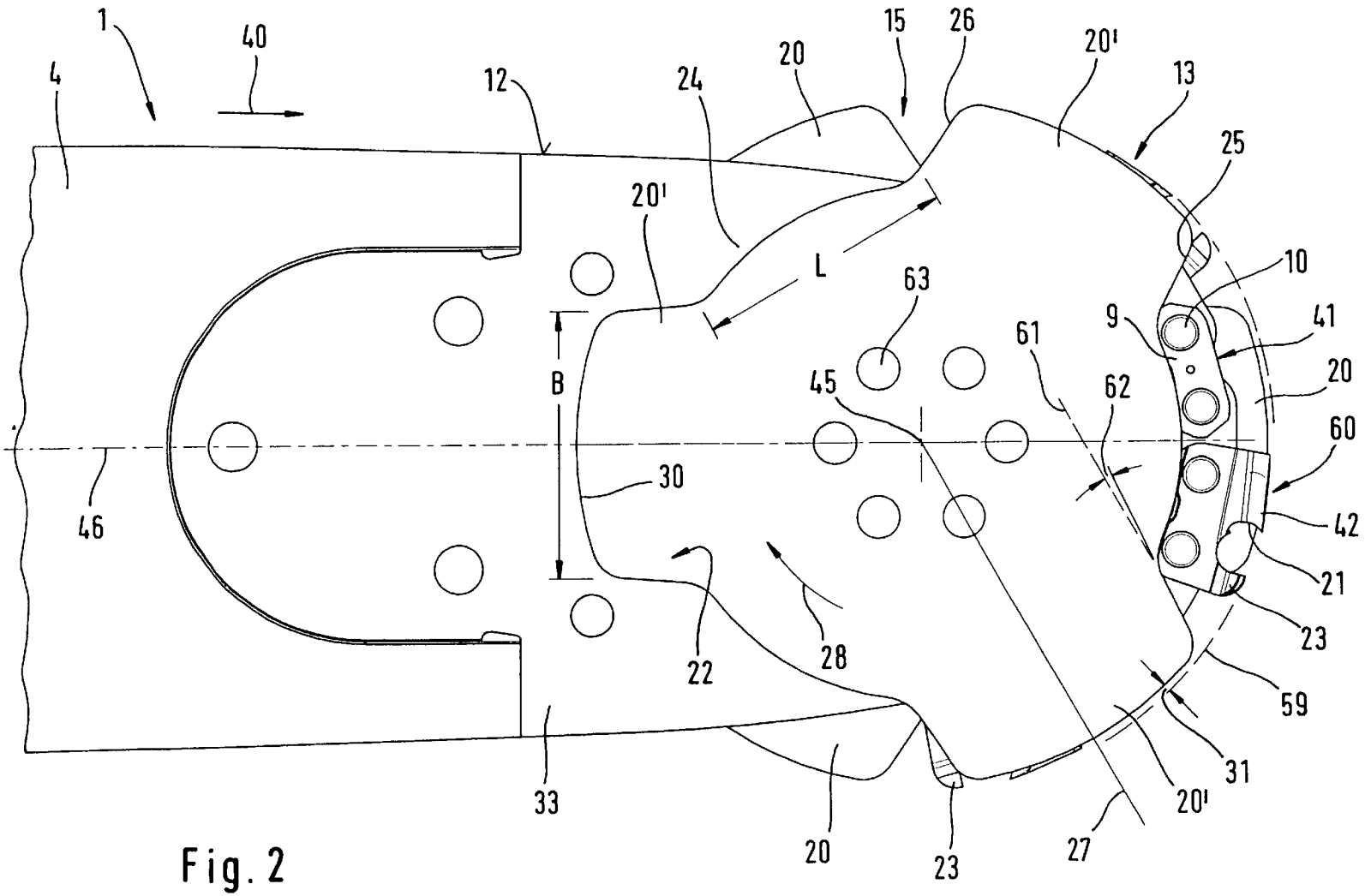
FIG. 2 is a side elevation view of the end portion of the guide bar of FIG. 1.

FIG. 1 is a schematic view of a portable handheld work apparatus 2 which is shown here as a motor-driven chain saw 3. A guide bar 1 for a saw chain 6, which runs thereon, is fixed to the housing 36 of the motor-driven chain saw 3. The guide bar 1 is clamped with an attachment end 37 between a sprocket-wheel cover 38 and the housing 36 and is configured essentially of an elongated flat base body 4. The saw chain 6 is driven by a drive motor 39 of the motor-driven chain saw 3 in the running direction 40. The drive motor is an internal combustion engine having a reciprocating or rotating piston and is driven in accordance with a two-stroke method or four-stroke method.

As shown in FIGS. 2 to 8, the saw chain 6 comprises connecting links 9, which are configured as simple side links 41, and cutting links 8. Each cutting link 8 includes a front cutting edge 21 which, referred to the running direction 40 of the saw chain 6, is offset laterally toward the outside. Each cutting link 8 also includes a roof section 42 having a roof cutting edge 32 with the roof section 42 being angled to the center drive link 7. A depth limiter 23 is provided on the cutting link 8 in running direction 40 ahead of the roof cutting edge 32. A guide groove 5 is provided in the outer periphery of the guide bar 1 and rakers 11 of the center drive links 7 engage therein. The center drive links 7 as well as the lateral connecting links 9 are pivotally connected to each other with the aid of pins 10. The pins 10 are configured as rivets in the embodiment shown. The cutting links 8 (especially the front cutting edges 21 of the cutting links 8) are arranged alternately on the right and left longitudinal sides of the saw chain 6.

The connecting links 9 glide with their foot sections 43 on the guide surfaces 12 which are arranged on the outer periphery 44 of the guide bar 1 on both longitudinal sides of the guide groove 5. A left guide plate 15 and a right guide plate 16 in the form of rotating guide discs 17 and 18 are provided on the direction-changing section 14 of the free end or tip 13 of the guide bar. The rotational axis 45 of the guide discs (17, 18) lies on the longitudinal center axis 46 of the guide bar 1. The guide discs (17, 18) are connected to an idler sprocket 19 so as to rotate therewith and are rotatably entrained by the running saw chain 6.

As shown in FIG. 1, the attachment end 37 of the guide bar 1 includes a longitudinal slot 47 lying on the longitudinal center axis 46. Clamping bolts, which lie fixedly in the housing 36 of the motor-driven chain saw 3, extend through the longitudinal slot 47 when fixing the guide bar 1 on the housing 36. The motor-driven chain saw 3 is guided and held with a forward handle 48 extending over the housing 36 as well as a rearward handle 49. A hand guard 50 is assigned to the forward handle 48 for protecting an operator of the chain saw 3. A safety-braking device is activated via the hand guard 50 and brings the saw chain 6, which runs in the direction of arrow 40, to standstill in fractions of a second in order to protect the operator against the action of the moving saw chain 6. A throttle lever 51 is provided in the rearward handle 49 in the grasping region of a hand of the operator and a throttle lever latch 52 is assigned thereto.

Figure 3:
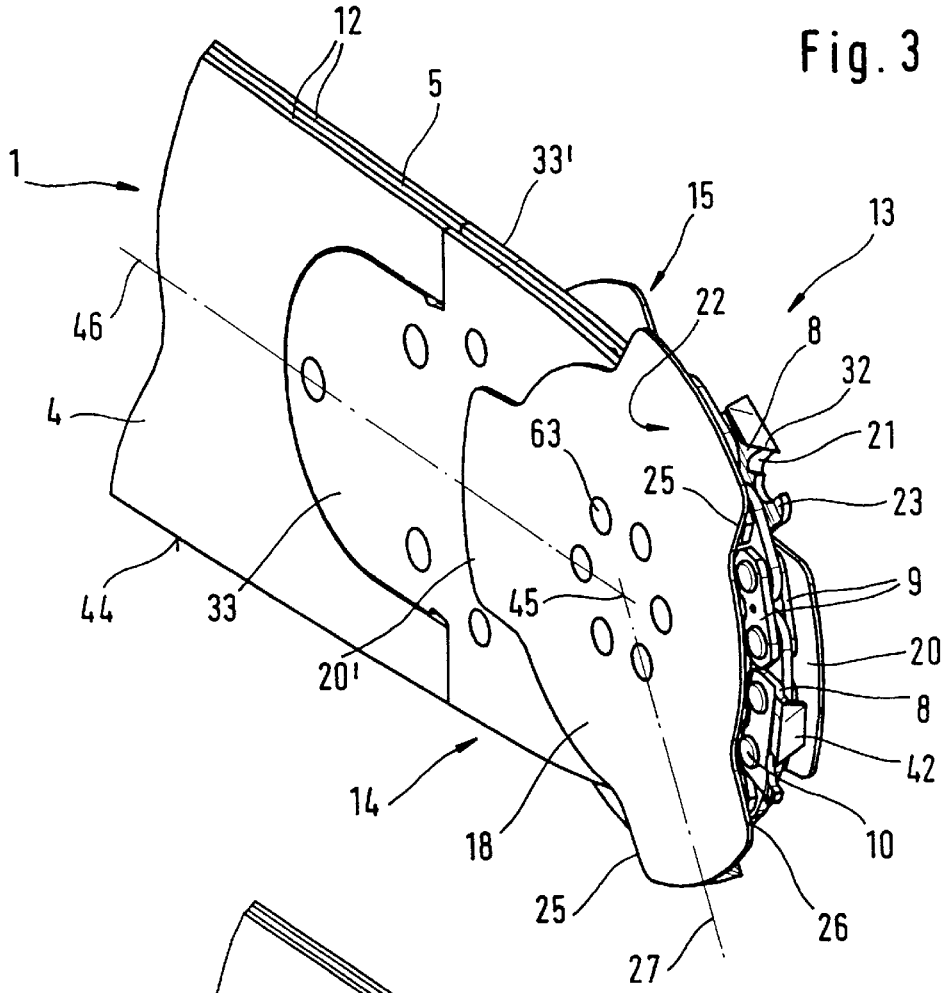
FIG. 3 is a perspective view of the end portion shown in FIG. 2.
Figure 4:
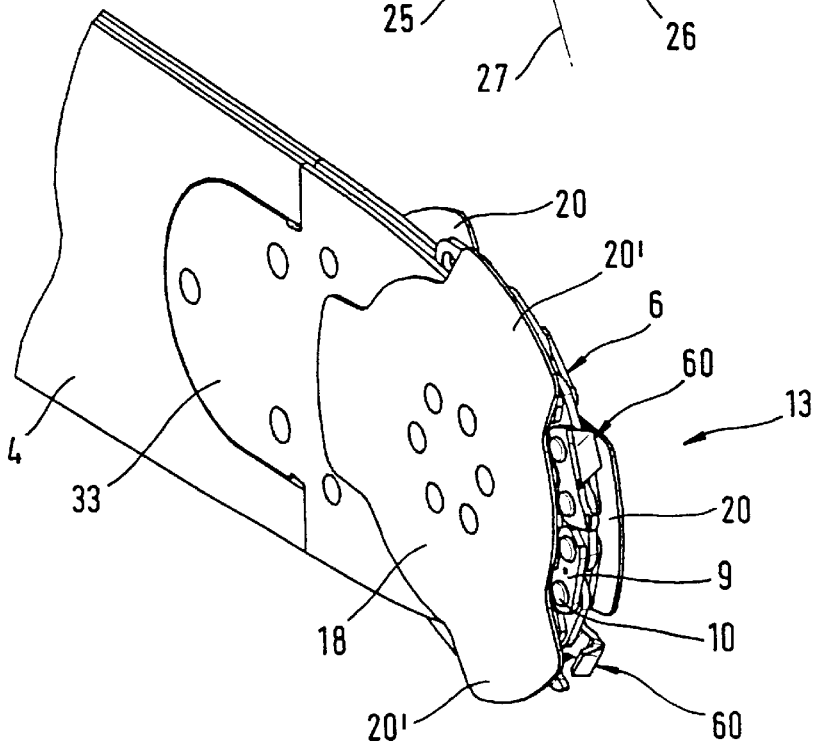
FIG. 4 is a variation of the embodiment shown in FIG. 3.
Figure 5:
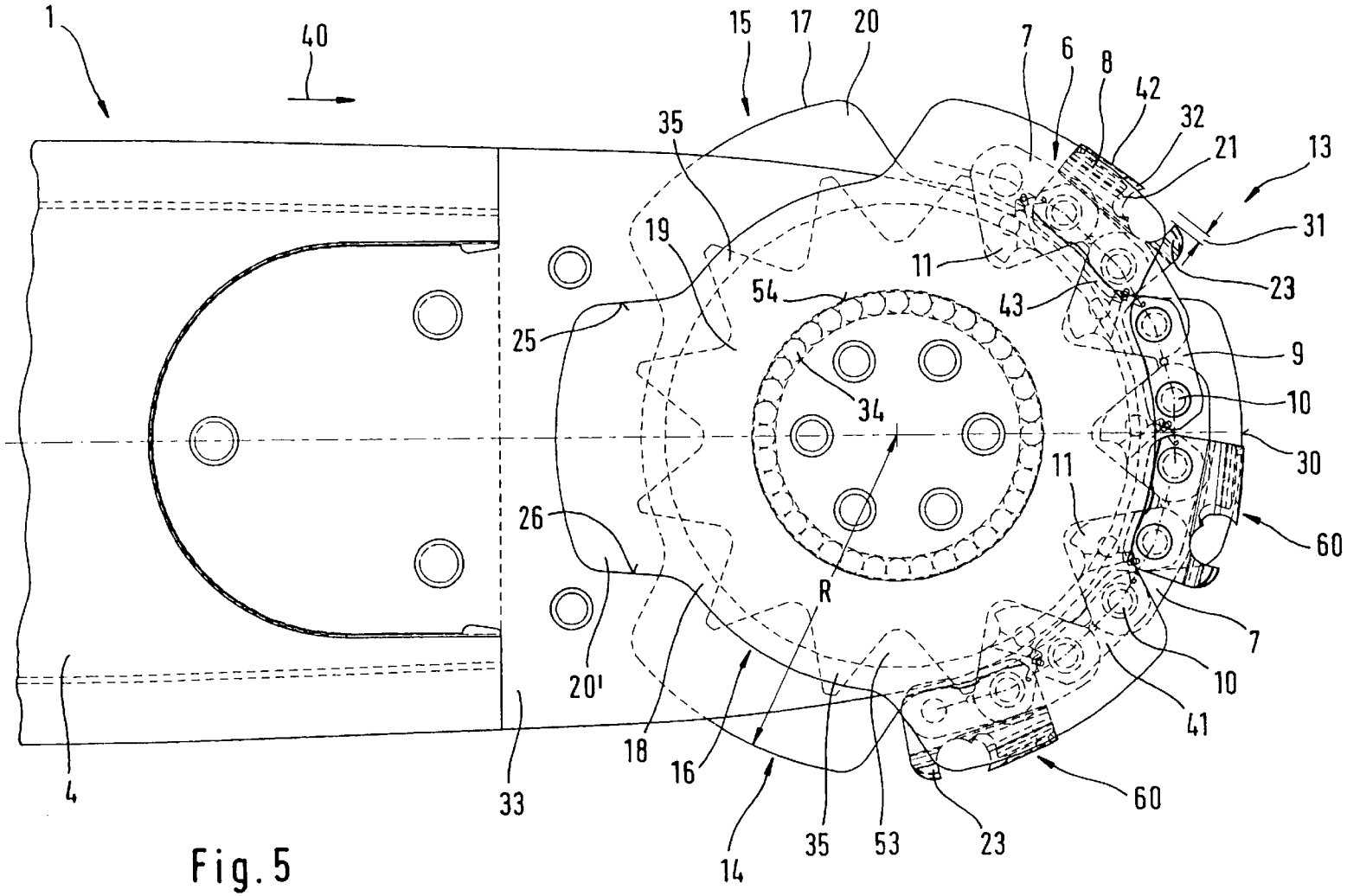
FIG. 5 is a partial cutaway view of the end portion shown in FIGS. 2 and 3.
Figure 6:
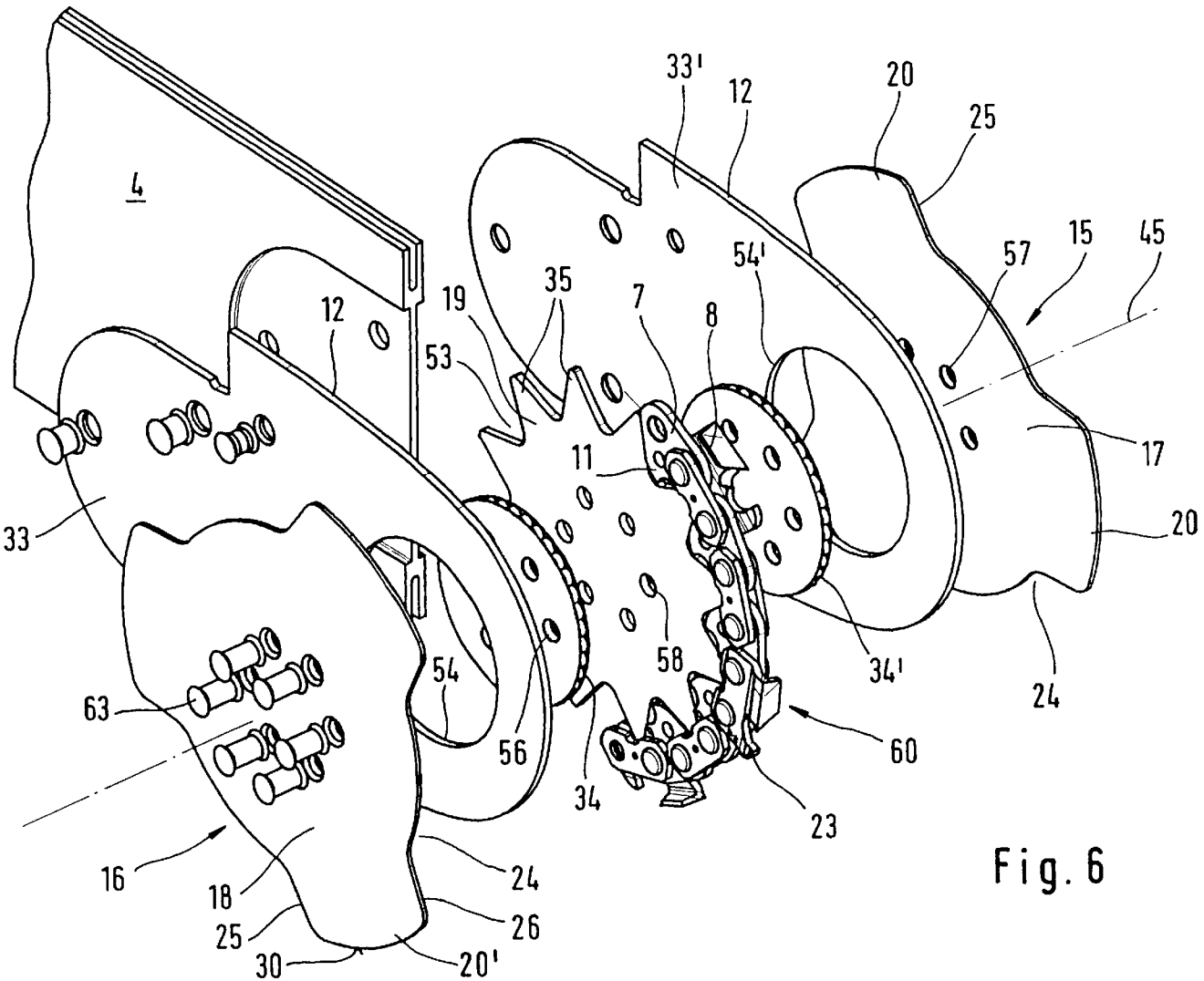
FIG. 6 is an exploded view of the end portion of the guide bar shown in FIG. 3.

The direction-changing section 14 of the guide bar 1 is formed of two side plates (33, 33') as shown in FIGS. 3 and 6. The idler sprocket 19 is mounted between the two side plates (33, 33') and is configured similarly to a toothed wheel. The rakers 11 of the drive links 7 engage in respective gaps 53 between each two mutually adjacent teeth 35 of the idler sprocket 19. The outer edges of the side plates (33, 33') define the guide surface 12 at the direction-changing section 14. The side plates (33, 33') are attached to the base body 4 of the guide bar 1 and have respective bearings (34, 34') which are held in respective bearing holders (54, 54') of the side plates (33, 33'). This is shown especially in FIGS. 5, 6 and 8. The base body 4 of the guide bar 1 can be made of solid material (see FIGS. 5 and 6) or can be configured in a light configuration having corresponding cutouts 55 (see FIG. 8).

The guide discs (17, 18) of the guide bar 1 are configured to have identical outlines. The left guide disc 17 and the right guide disc 18 are arranged on respective outer sides of the side plates (33, 33') which face away from the idler sprocket 19. The holders (54, 54') for the respective bearings (34, 34') are open toward the respective side plates discs (33, 33'). Each bearing (34, 34') has an opening 56 for accommodating rivets 63.

As shown schematically in FIG. 6, a particular rivet 63 engages through an opening 57 of the guide discs (17, 18), an opening 56 of the bearings (34, 34') and a corresponding opening 58 in the idler sprocket 19 as well as a next opening 56 in the bearing 34' of the side plate 33'. The rivets 63 project axially beyond the bearing 34' and engage through a correspondingly assigned opening 57 in the guide disc 18 so that the guide discs (17, 18) are connected so as to rotate with the idler sprocket 19. The idler sprocket 19 accommodates the raker 11 of a drive link 7 in each gap 53 in correspondence to its tooth pitch and the guide discs (17, 18) are connected in specific positions with the idler sprocket 19 so as to rotate therewith. For this reason, a relative movement between the saw chain 6 and the guide discs (17, 18) is reliably prevented.

The guide discs (17, 18), which are shown in FIGS. 2 to 6, each have three radially projecting sections (20, 20'). The number of teeth 35 of the idler sprocket 19 is twelve in FIGS. 2 to 5. As shown in FIGS. 2 to 5, each depth limiter 23 of a cutting link 8 is alternately covered in the axial direction of the rotational axis 45 by a radially projecting section 20 of the left disc 17 and a radially projecting section 20' of the right guide disc 18. The guide discs (17, 18) move on the outer sides of the side plates (33, 33') when viewed in the axial direction and project radially beyond the particular guide surfaces 12 of the side plates (33, 33'). The sections 20 of the guide disc 17 are arranged offset to the sections 20' of the guide disc 18 referred to the peripheral direction 28. The sections 20' are arranged in the center of a cutout 24 between two sections 20.

As shown in FIGS. 3 and 6, the front cutting edge 21 projects through a corresponding cutout 24 between the radially projecting sections (20, 20') and extends axially beyond the outer surfaces 22 of the guide discs (17, 18) so that the cutting width is somewhat greater than the thickness of the guide bar in the region of the guide discs (17, 18). The front cutting edge 21 projects in this manner because of its cropped form viewed in cross section. In the embodiments shown in FIGS. 2 to 6, a cutting link 8 comes to lie in a corresponding cutout 24 of a guide disc (17, 18) when viewed in the running direction of the saw chain 6. The width L (FIG. 2) of the cutout 24 between the radially projecting sections (20, 20') is in the peripheral direction approximately the same size as the width B of the radially projecting sections (20, 20') in the peripheral direction 28. The maximum radius R of the guide discs (17, 18) is so selected that the edge 30 of the guide discs (17, 18) ends at only a small distance 31 radially below the path traveled by the roof cutting edge 32 (see FIGS. 5 and 8). The roof cutting edge and front cutting edge of the cutting link 8 laterally project over the edge 30 of the guide discs so that the lateral cut also takes place in the direction-changing section 14 by a cutting tooth 60 of the cutting link 8. The radially running edges (25, 26) of the radial sections 20 are advantageously configured to be at an angle from the perpendicular 27 or a parallel 61 to the perpendicular 27. The radial edges (25, 26) extend in the radial direction viewed from the rotational axis 45 to the perpendicular 27 at an angle 62 of <15°, preferably approximately 2° to 5°. The offset arrangement of the cutting links 8 or cutting teeth 60 (when viewed in the peripheral direction 28 and in the running direction 40) can be achieved in a simple manner in that the saw chain 6 is placed offset by one tooth 35 of the idler sprocket as shown by a comparison of FIGS. 3 and 4 to each other. In this way, an arrangement with cutting links 8 can be configured whose depth limiter 23 is disposed in the region of the leading edge 25 of the section (20, 20') (see FIG. 3) or, however, the depth limiter comes to lie in the center region of the cutouts (20, 20') of the opposite-lying guide disc (17, 18) and is covered thereby (see FIG. 4). It can also be practical to configure the radially extending edges (25, 26) of the radially projecting sections 20 as cutting edges. In this way, the guide bar 1 can be turned over and, on the other hand, the chip-producing power of the saw chain 6 is favorably influenced.

In all of the embodiments shown, the guide discs (17, 18) are driven by the moved saw chain 6.

Figure 7:
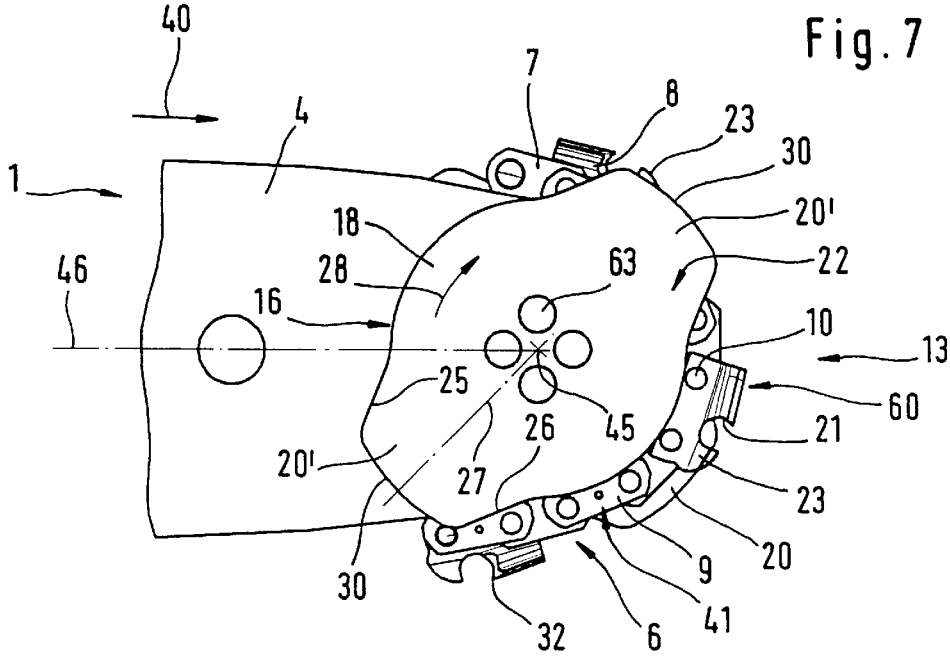
FIG. 7 is a view of a variation of the end portion of a guide bar according to the invention; and, FIG. 8 is an enlarged view of the end portion of the guide bar of FIG. 7.
Figure 8:
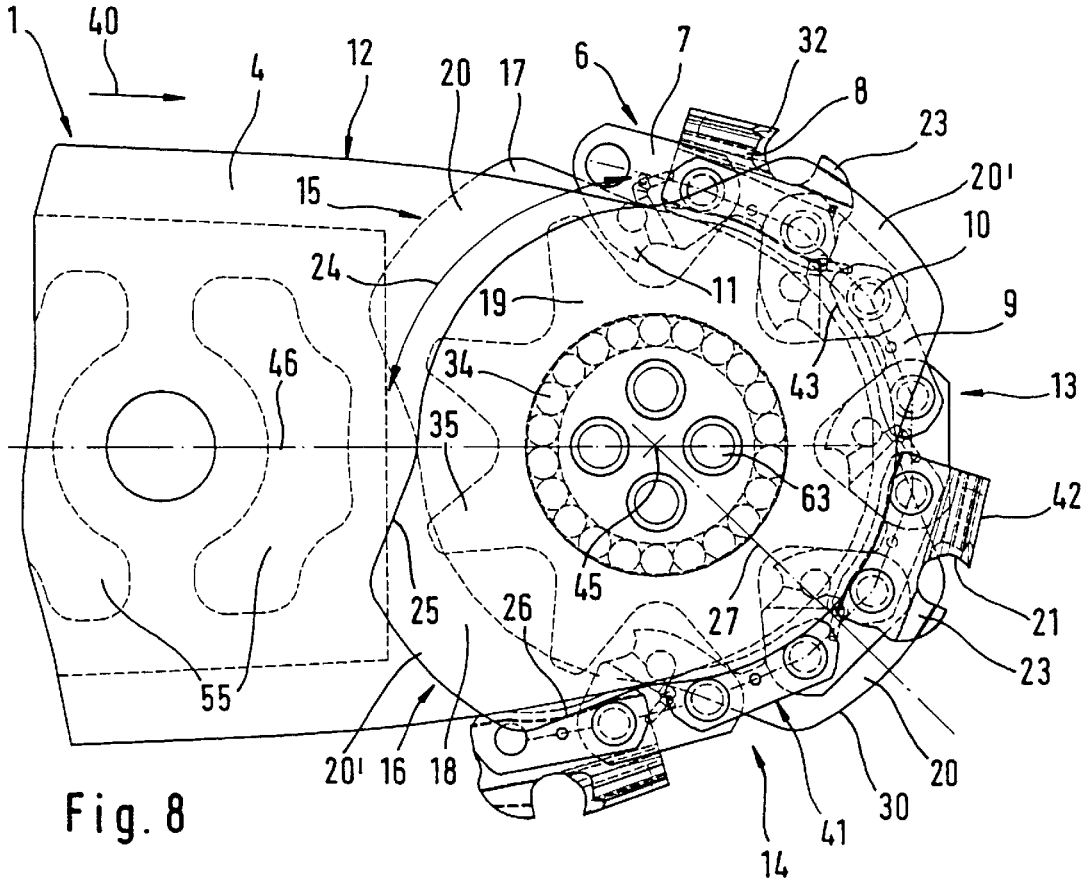

The guide discs in FIGS. 2 to 6 each have three radially projecting sections 20 and an idler sprocket 19 whose tooth count can be divided by four; thus, the teeth count of the idler sprocket 19 is twelve teeth 35. The guide discs (17, 18) of the guide bar, which is shown in FIGS. 6 and 7, each have two radially projecting sections 20 and are driven by an idler sprocket 19 whose teeth count is, in turn, dividable by four; thus, the idler sprocket 19 is driven with eight teeth 35 via the moved saw chain 6.

If a guide bar configured in accordance with the invention is plunged with the free end 13 into wood as it is necessary, for example, with tree maintenance, then too great a depth of penetration of the roof cutting edge 32 into the wood is reliably prevented by the radially projecting sections 20.

It is understood that the foregoing description is that of the preferred embodiments of the invention and that various changes and modifications may be made thereto without departing from the spirit and scope of the invention as defined in the appended claims.

What is claimed is:

1. A guide bar for a portable handheld work apparatus including a motor-driven chain saw or overhead branch cutter, the guide bar being for a saw chain including cutting links, lateral connecting links and center drive links pivotally connected to each other via rivets or pins with the drive links having respective rakers formed thereon, the guide bar comprising:

an elongated planar base body defining an outer periphery wherein a peripheral guide groove is provided for receiving said rakers therein and for guiding said saw chain along said outer periphery;

said guide bar having guiding surfaces along said outer periphery for supporting said lateral connecting links and said cutting links and said guiding surfaces being separated from each other by said guide groove;

said guide bar having a direction-changing section at the outer free end thereof for guiding said saw chain over the outer free end of said guide bar;

guide plates mounted on said base body in said direction-changing section and extending radially beyond said guiding surfaces to laterally cover said connecting links and said cutting links of said saw chain;

an idler sprocket rotatably mounted in said direction-changing section;

said guide plates being configured as rotating left and right guide discs and said guide discs being connected to said idler sprocket so as to rotate therewith; and, said left guide disc having a set of radially projecting first sections and said right guide disc having a set of radially projecting second sections arranged offset with respect to corresponding ones of said first sections.

2. The guide bar of claim 1, wherein each two of said radially projecting first sections defines a cutout therebetween and each two of said radially projecting second sections define a cutout therebetween; and, said radially projecting first sections are arranged so as to lie in approximately the center of the cutouts between said second sections.

3. The guide bar of claim 1, wherein each of said cutting links includes a front cutting edge which is partially covered or overlapped by a section of the guide disc lying axially opposite thereto.

4. The guide bar of claim 3, wherein the front cutting edge projects axially beyond the outer surface of the guide disc corresponding thereto.

5. The guide bar of claim 4, wherein each cutting link includes a forward end viewed in the direction of movement whereat a depth limiter is provided.

6. The guide bar of claim 5, wherein the depth limiter of one of the cutting links is arranged in the center region of one of the radially projecting sections of the guide disc lying axially opposite to said depth limiter and is covered or overlapped thereby.

7. The guide bar of claim 5, wherein each radially projecting section has a leading radial edge viewed in the direction of movement of the saw chain; and, the depth limiter of each cutting link is arranged in the region of the leading radial edge of the radially projecting section of the guide disc lying axially opposite to said depth limiter.

8. The guide bar of claim 2, wherein a cutting link comes to lie approximately in the center in a cutout between the radially projecting sections.

9. The guide bar of claim 7, wherein said leading radial edge is at an angle with respect to a center perpendicular of the radially projecting section defining the leading radial edge.

10. The guide bar of claim 2, wherein each of said cutouts of each of said guide discs is approximately equal to the width (B) of one of the radially projecting sections viewed in the peripheral direction.

11. The guide bar of claim 2, wherein each of the radially projecting sections has an outer edge at a small spacing below the roof cutting edge of the corresponding cutting link.

12. The guide bar of claim 2, wherein said guide discs are driven by the moving saw chain.

13. The guide bar of claim 2, wherein each of said guide discs has three radially projecting sections.

14. The guide bar of claim 2, wherein each of said guide discs has two radially projecting sections.

15. The guide bar of claim 2, wherein said idler sprocket has a number of teeth which is 4 times the number of radially projecting sections of one of said guide discs.

16. The guide bar of claim 1, wherein said guide bar can be turned over.

* * * * *